US011509059B2

(12) United States Patent
Öhgren

(10) Patent No.: US 11,509,059 B2
(45) Date of Patent: Nov. 22, 2022

(54) WAVEGUIDE POLARIZER AND A CIRCULARLY POLARIZED ANTENNA

(71) Applicant: RUAG SPACE AB, Gothenburg (SE)

(72) Inventor: Mikael Öhgren, Öjersjö (SE)

(73) Assignee: RUAG SPACE AB, Gothenburg (SE)

( * ) Notice: Subject to any disclaimer, the term of this patent is extended or adjusted under 35 U.S.C. 154(b) by 0 days.

(21) Appl. No.: 17/224,502

(22) Filed: Apr. 7, 2021

(65) Prior Publication Data

US 2021/0320424 A1 Oct. 14, 2021

(30) Foreign Application Priority Data

Apr. 8, 2020 (EP) ..... 20168655

(51) Int. Cl.

| | |
|---|---|
| ***H01Q 15/24*** | (2006.01) |
| ***H01Q 1/24*** | (2006.01) |
| ***H01Q 1/40*** | (2006.01) |
| ***H01Q 9/04*** | (2006.01) |
| ***H01Q 21/24*** | (2006.01) |

(52) U.S. Cl.

CPC ..... *H01Q 15/244* (2013.01); *H01Q 1/246* (2013.01); *H01Q 1/405* (2013.01); *H01Q 9/0492* (2013.01); *H01Q 21/245* (2013.01)

(58) Field of Classification Search

CPC ..... H01Q 15/244; H01Q 1/246; H01Q 1/405; H01Q 9/0492; H01Q 21/245; H01Q 13/0241; H01Q 13/065

See application file for complete search history.

(56) References Cited

U.S. PATENT DOCUMENTS

| | | | | |
|---|---|---|---|---|
| 3,778,839 | A | 12/1973 | Kovar | |
| 5,699,072 | A | 12/1997 | Tokuda et al. | |
| 9,972,897 | B1 * | 5/2018 | Rao | H01Q 21/064 |
| 2021/0184359 | A1 * | 6/2021 | Leung | H01Q 13/0241 |

FOREIGN PATENT DOCUMENTS

| | | | | |
|---|---|---|---|---|
| CN | 110034404 A | * | 7/2019 | H01Q 13/02 |
| JP | H0974311 A | | 3/1997 | |

OTHER PUBLICATIONS

Extended European Search Report dated Sep. 21, 2020 for European Application No. 20168655.7, 9 pages.

* cited by examiner

*Primary Examiner* — Hoang V Nguyen

(74) *Attorney, Agent, or Firm* — Sage Patent Group

(57) ABSTRACT

A waveguide polarizer for converting between a linearly polarized electromagnetic field in a first waveguide and a circularly polarized electromagnetic field in a second waveguide is provided. The waveguide polarizer includes a structure interconnecting the first and second waveguide which includes a waveguide excitation arrangement with a bifilar helical shape. A circularly polarized antenna arranged to be connected to the first waveguide of the waveguide polarizer and a satellite arrangement are also provided.

17 Claims, 5 Drawing Sheets

WAVEGUIDE POLARIZER AND A CIRCULARLY POLARIZED ANTENNA

CROSS-REFERENCE TO RELATED APPLICATIONS

The present application for patent claims priority to European Patent Office Application Ser. No. 20168655.7, entitled "A WAVEGUIDE POLARIZER AND A CIRCULARLY POLARIZED ANTENNA" filed on Apr. 8, 2020, assigned to the assignee hereof, and expressly incorporated herein by reference.

TECHNICAL FIELD OF THE INVENTION

Embodiments herein relate in general to circularly polarized antennas. In particular, embodiments herein relate to a waveguide polarizer and a circularly polarized antenna comprising a waveguide polarizer. Also, the embodiments herein also relate to a satellite arrangement comprising a waveguide polarizer or a circularly polarized antenna comprising a waveguide polarizer.

BACKGROUND

Circularly polarized (CP) antennas are one type of antennas that have a circular polarization. CP antennas are becoming a key technology for various wireless systems including, for example, satellite communications, mobile communications, global navigation satellite systems (GNSS), wireless sensors, radio frequency identification (RFID), wireless power transmission, wireless local area networks (WLAN), wireless personal area networks (WPAN), Worldwide Interoperability for Microwave Access (WiMAX) and Direct Broadcasting Service (DBS) television reception systems, etc.

Due to the features of circular polarization, CP antennas have several important advantages compared to antennas using linear polarizations. For example, a CP antenna is very effective in combating multi-path interferences or fading. The reflected radio signal from the ground or other objects will result in a reversal of polarization, that is, right-hand circular polarization (RHCP) reflections show left-hand circular polarization (LHCP). A RHCP antenna will have a rejection of a reflected signal which is LHCP, thus reducing the multi-path interferences from the reflected signals. Another advantage is that a CP antenna is able to reduce the 'Faraday rotation' effect due to the ionosphere making it particularly well-suited for satellite communications. Also, in space communications, CP mitigates the potential effects of changes in the relative orientation between the transmitting and receiving antennas.

In space, a satellite antenna transmits and receives modulated carrier signals within the radio frequency (RF) part of the electromagnetic spectrum. For satellite communication, the frequencies may typically range between about 0.3 GHz (VHF-band) to around 50 GHz (Q-/V-band). These frequencies represent microwaves having wavelengths ranging from 1 meter down to a few millimetres. The satellite antennas are normally customized to handle these high frequencies and small wavelengths. For example, pipe antennas for omnidirectional coverage are widely used for Telemetry, Tracking and Command (TTC) communication in satellites today.

If a pipe antenna is to radiate circular polarization, the pipe antenna is required to be excited by a feed component for generating the circular polarization. Normally, a septum polarizer is used to generate the circular polarization. However, adding a septum polarizer to a pipe antenna will also add significantly to the weight and volume of the resulting antenna assembly. FIG. 1 shows a pipe antenna assembly 10 (left) comprising a pipe 11 and a septum polarizer 12. The septum polarizer 12 forms a significant part of the total length A of the antenna assembly 10.

For all space applications and satellite arrangements, there is a constant need to reduce the weight and volume of all components and parts, including antennas.

SUMMARY OF THE INVENTION

It is an object of embodiments herein to enable a small and low weight circularly polarized antenna.

According to a first aspect of embodiments herein, the object is achieved by a waveguide polarizer for converting between a linearly polarized electromagnetic field in a first waveguide and a circularly polarized electromagnetic field in a second waveguide. The waveguide polarizer comprises a structure interconnecting the first and second waveguide comprising a waveguide excitation arrangement with a bifilar helical shape.

According to a second aspect of embodiments herein, the object is achieved by a circularly polarized antenna comprising a waveguide polarizer as described above.

According to a third aspect of the embodiments herein, the object is achieved by a satellite arrangement comprising a waveguide polarizer or a circularly polarized antenna as described above.

By providing a waveguide polarizer as described above, a reciprocal transition between a linearly polarized electromagnetic field in a first waveguide and a circularly polarized electromagnetic field in a second waveguide is enabled that removes the need for a septum polarizer when implementing a circularly polarized antenna. Thus, since the added weight and volume of a septum polarizer is removed, the weight and volume of the circularly polarized antenna may be significantly reduced. Hence, a small and low weight circularly polarized antenna is enabled.

BRIEF DESCRIPTION OF FIGURES

Features and advantages of the embodiments will become readily apparent to those skilled in the art by the following detailed description of exemplary embodiments thereof with reference to the accompanying drawings, wherein.

DETAILED DESCRIPTION

Figure 1:
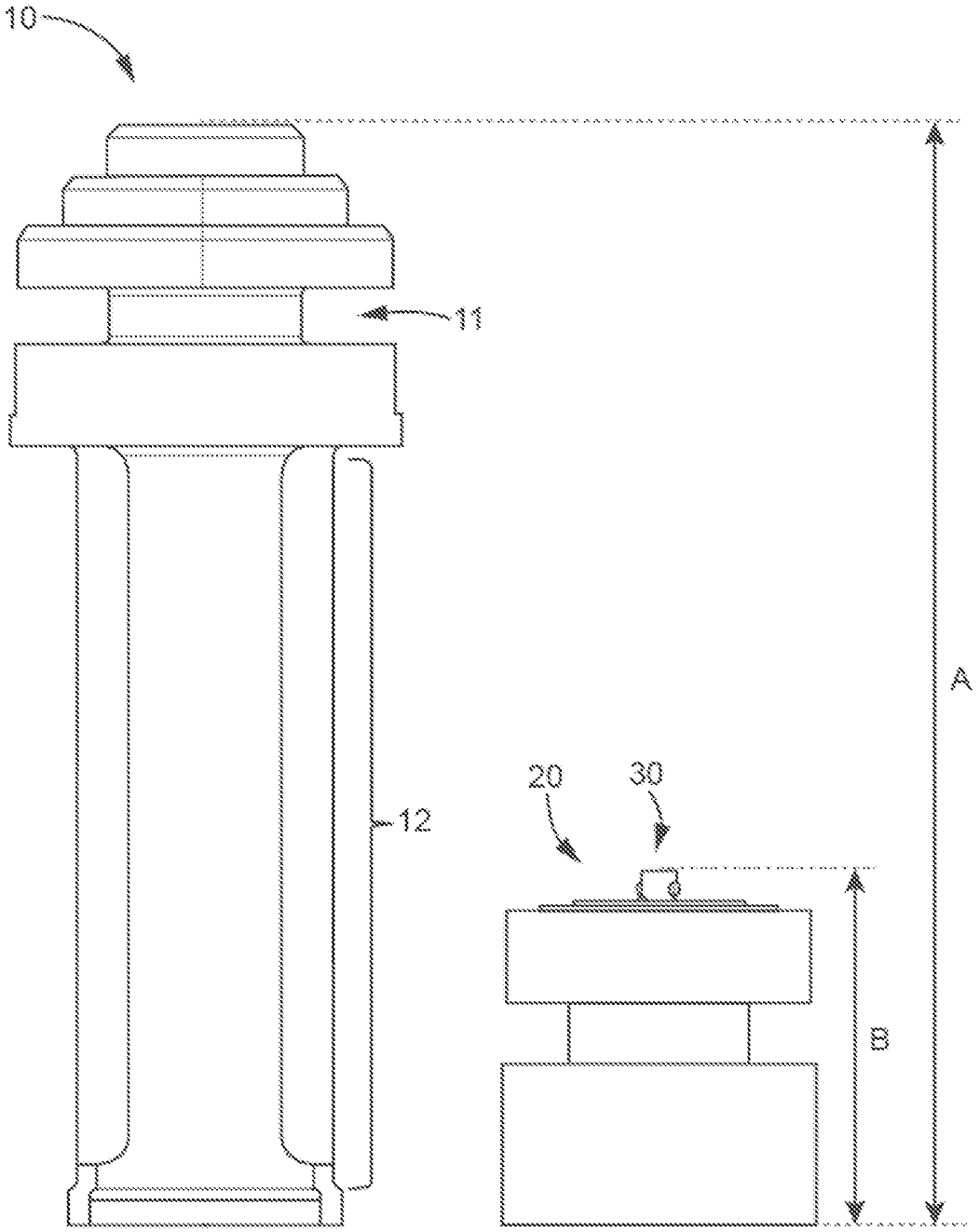
FIG. 1 shows a schematic illustration comparing a circularly polarized pipe antenna according to prior art (left) and a circularly polarized antenna according to some embodiments (right)

The figures are schematic and simplified for clarity, and they merely show details which are essential to the understanding of the embodiments presented herein, while other details have been left out. Throughout, the same reference numerals are used for identical or corresponding parts or steps.

FIG. 1 shows a circularly polarized antenna 20 (right) according to some embodiments. The circularly polarized antenna 20 is a compact radiator which may provide circular polarization to a wave feed from a linear polarized wave guide. The circularly polarized antenna 20 comprises a waveguide polarizer 30 for achieving the circular polarization. Embodiments of the waveguide polarizer 30, which may also be referred to herein as a bifilar helix radiator, is described in more detail below with reference to FIGS. 2-7. The circularly polarized antenna 20 may either be configured for a right-hand circular polarization, RHCP, or left-hand circular polarization, LHCP.

Furthermore, the waveguide polarizer 30 is here placed or located inside the pipe of the circularly polarized antenna 20 enabling a significantly more compact antenna assembly for the circularly polarized antenna 20. This is illustrated in FIG. 1 by the total length B of the circularly polarized antenna 20 being significantly shorter that the total length A of the circularly polarized pipe antenna 10 according to prior art. Here, it should also be noted that no septum polarizer is implemented, or needed, in the circularly polarized antenna 20.

Figure 2:
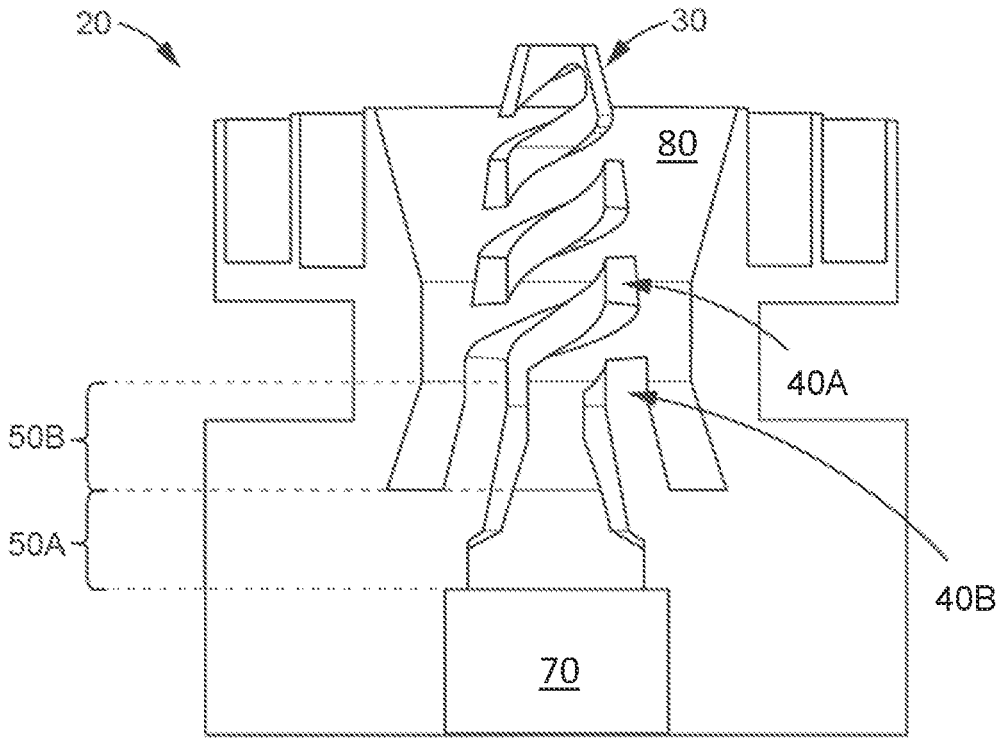
FIGS. 2-3 shows a first and a second cross-sectional view of a circularly polarized antenna according to some embodiments.
Figure 3:
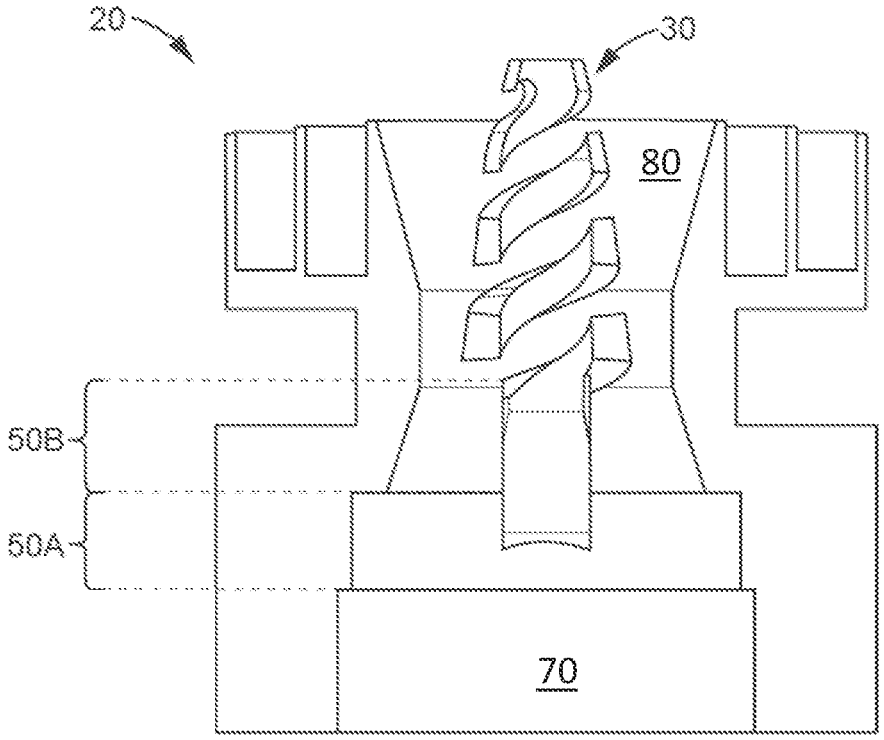

FIG. 2-3 shows a first and a second cross-sectional view of a circularly polarized antenna 20 comprising a waveguide polarizer 30 according to some embodiments. The circularly polarized antenna 20 comprises a first waveguide 70 and a second waveguide 80. The first waveguide 70, or input waveguide, may be provided with a wave feed producing a linearly polarized electromagnetic field in the first waveguide 70. Here, the first waveguide 70 may be arranged to be connected to a feed component or network (not shown) configured to provide the wave feed for the first waveguide 70. According to one example, the first waveguide 70 may have a rectangular cross-section. However, according to other examples, the first waveguide 70 may also have a super-elliptical cross-section, a rectangular cross-section with rounded edges, or a cross-section including ridges. Further, according to one example, the second waveguide 80 may have a circular cross-section. However, according to other examples, the second waveguide 80 may also have a super-circular cross-section, a square cross-section, or a square cross-section with rounded edges. Furthermore, it should also be noted that, although not mentioned explicitly above, other cross-sections of the first and second waveguide 70, 80 may also be envisioned.

In the example shown in FIGS. 2-3, the waveguide polarizer 30 is arranged to convert the linearly polarized electromagnetic field in the first waveguide 70 into a circularly polarized electromagnetic field in the second waveguide 80. However, it should also be noted that the waveguide polarizer is reciprocal and may thus also be used to convert a circularly polarized electromagnetic field in one waveguide into a linearly polarized electromagnetic field in another waveguide. The waveguide polarizer 30 comprises a structure 30, 50A, 50B interconnecting the first and second waveguide 70, 80. The structure 30, 50A, 50B further comprises a waveguide excitation arrangement with a bifilar helical shape 40A, 40B, also referred to herein as a bifilar helix.

In some embodiments, the structure 30, 50A, 50B may comprise two matching sections 50A, 50B. The first matching section may be a transition waveguide 50A and the second matching section may be a third waveguide 50B. The transition waveguide 50A may interconnect the first waveguide 70 with the third waveguide 50B. The transition waveguide 50A may also provide an impedance match between first waveguide 70 and the third waveguide 50B. Here, the transition waveguide 50A may be said to comprise a transmission line with a characteristic impedance and a specific length. The length of the transition waveguide 50B may typically be a quarter of a wavelength of the propagating electromagnetic field in the first waveguide 70. The third waveguide 50B may interconnect with, or form part of, the waveguide excitation arrangement with a bifilar helical shape 40A, 40B.

According to some embodiments, the waveguide excitation arrangement with a bifilar helical shape 40A, 40B, may consist of two helical filaments 40A that are connected to opposite sides of the first waveguide 70. In some embodiments, the waveguide excitation arrangement with the bifilar helical shape 40A, 40B may be galvanically connected to the first waveguide 70 on opposing sides. In some embodiments, the waveguide excitation arrangement with the bifilar helical shape 40A, 40B is galvanically connected to ridges 40B on opposing sides of the first waveguide 70. Here, it should also be understood that the bottom part of the two helical filaments 40A may form the ridges 40B on the opposing sides of the first waveguide 70. The ridges 40B may also provide matching of the bifilar helix and some mechanical advantages. In some embodiments, the two helical filaments 40A may be shorted or open at the top.

Figure 4:
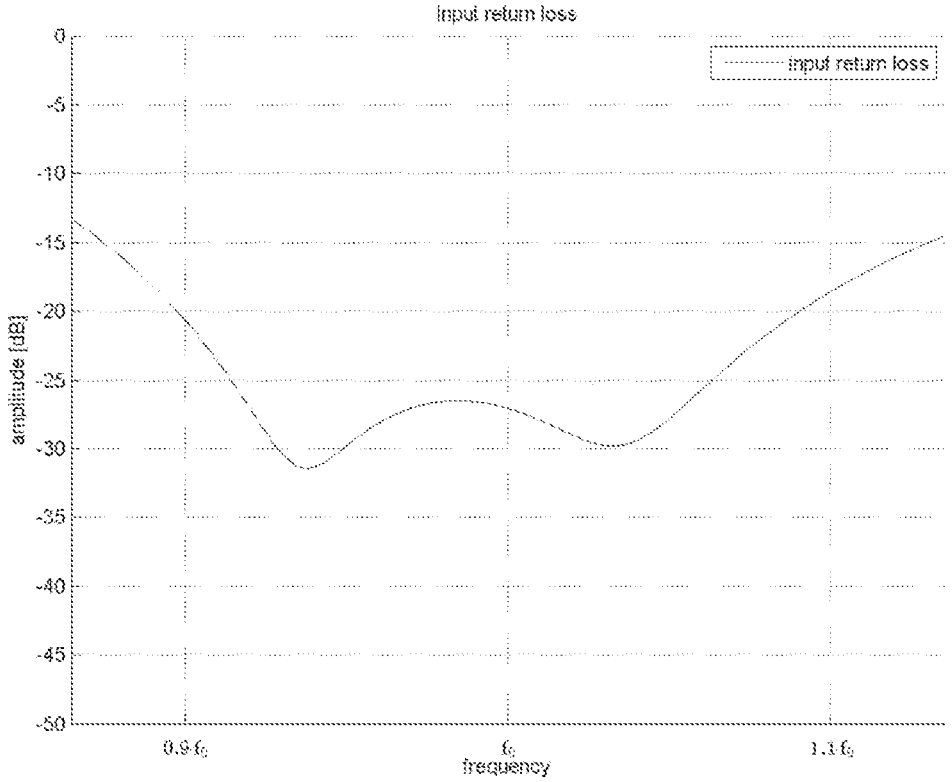
FIGS. 4-5 shows diagrams illustrating examples of input return loss and directivity, respectively, for a circularly polarized antenna according to some embodiments.

FIG. 3 shows a diagram illustrating an example of input return loss of a circularly polarized antenna 20 according to some embodiments. FIG. 4 shows a diagram illustrating an example of directivity of a circularly polarized antenna 20 according to some embodiments. The directivity is here shown for a number of frequency points defined by the centre frequency f0 and a frequency bandwidth of ±10%. The frequency bandwidth of the circularly polarized antenna 20 is significantly large, i.e. about 20%, and diagrams of FIGS. 3-4 demonstrates the performance for the circularly polarized antenna 20 for a 20% frequency bandwidth.

Figure 5:
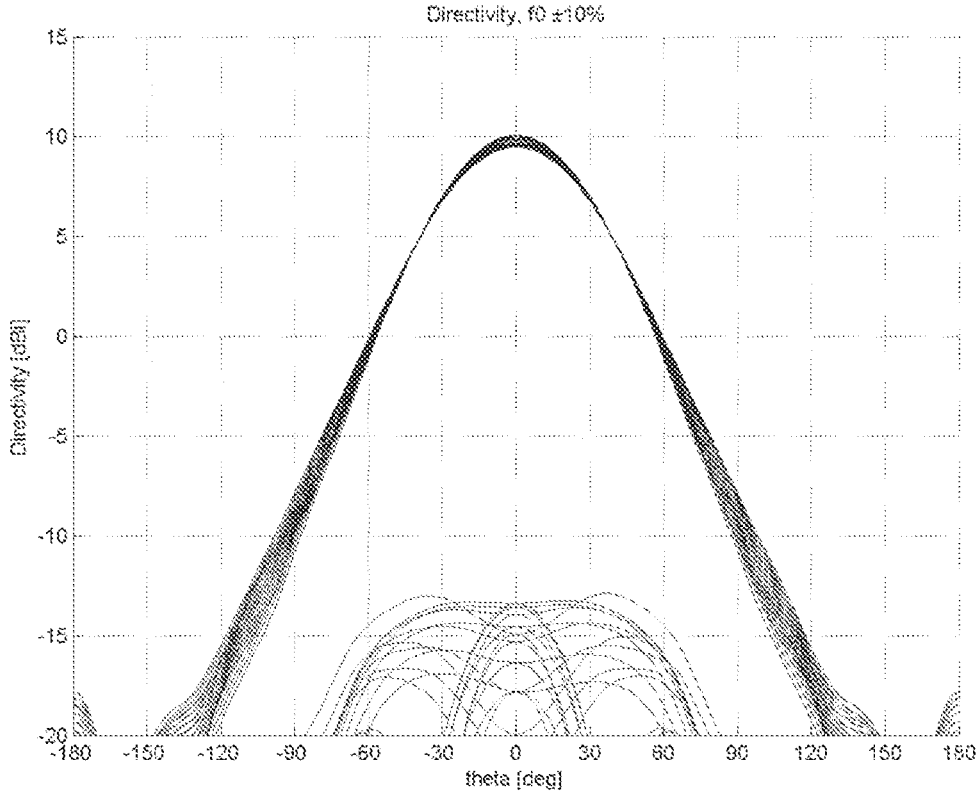

FIG. 5 shows a perspective view of a circularly polarized antenna 20 according to some embodiments. As may be seen in the example shown in FIG. 5, the circularly polarized antenna 20 may comprise a reflector or cup 21. Optionally, the reflector or cup 21 may be surrounded by one or more choke rings 22, 23. Here, it may be noted that it is the size and shape of the bifilar helix 40A, 40B and the reflector 21 that together shapes the radiation pattern of the circularly polarized antenna 20. The optional choke rings 22, 23 may also assist in the shaping of the radiation pattern of the circularly polarized antenna 20, but may also be used to reduce the back radiation from being received by the circularly polarized antenna 20.

Figure 6:
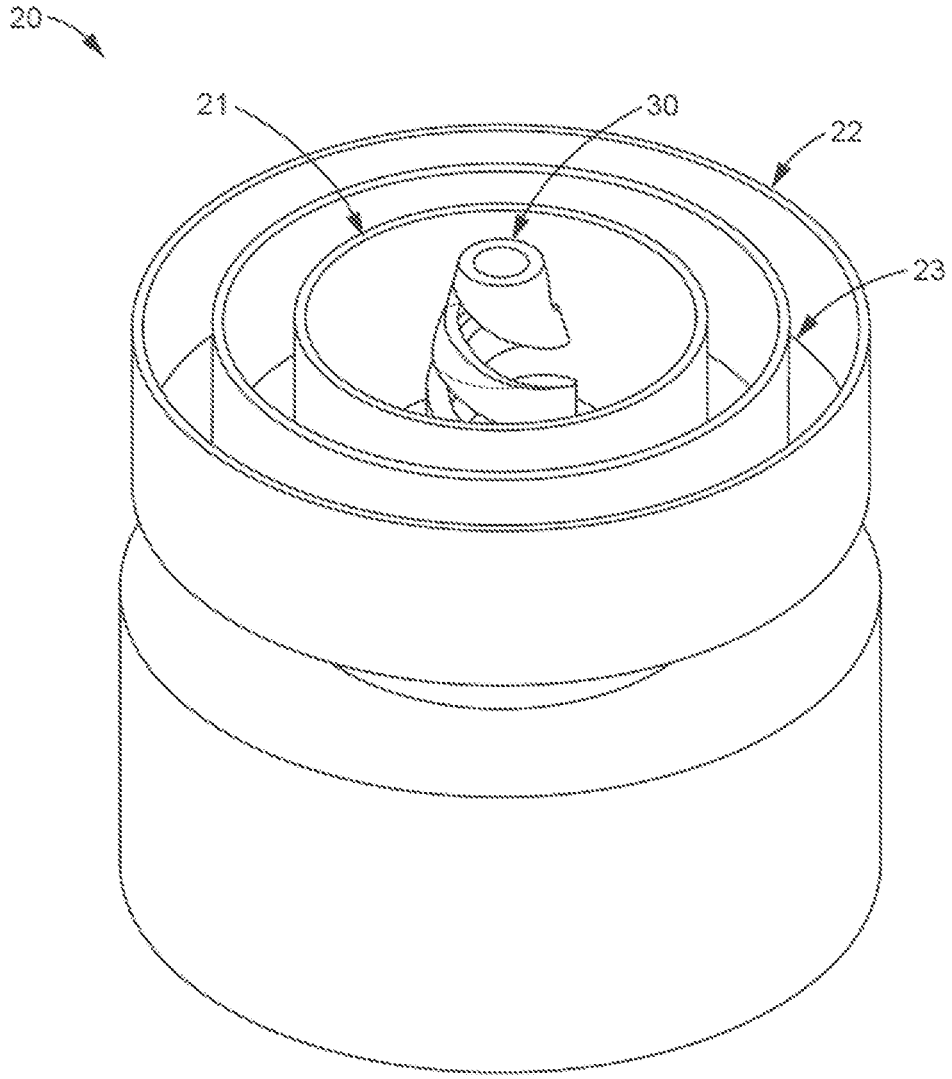
FIG. 6 shows a perspective view of a circularly polarized antenna according to some embodiments.
Figure 7:
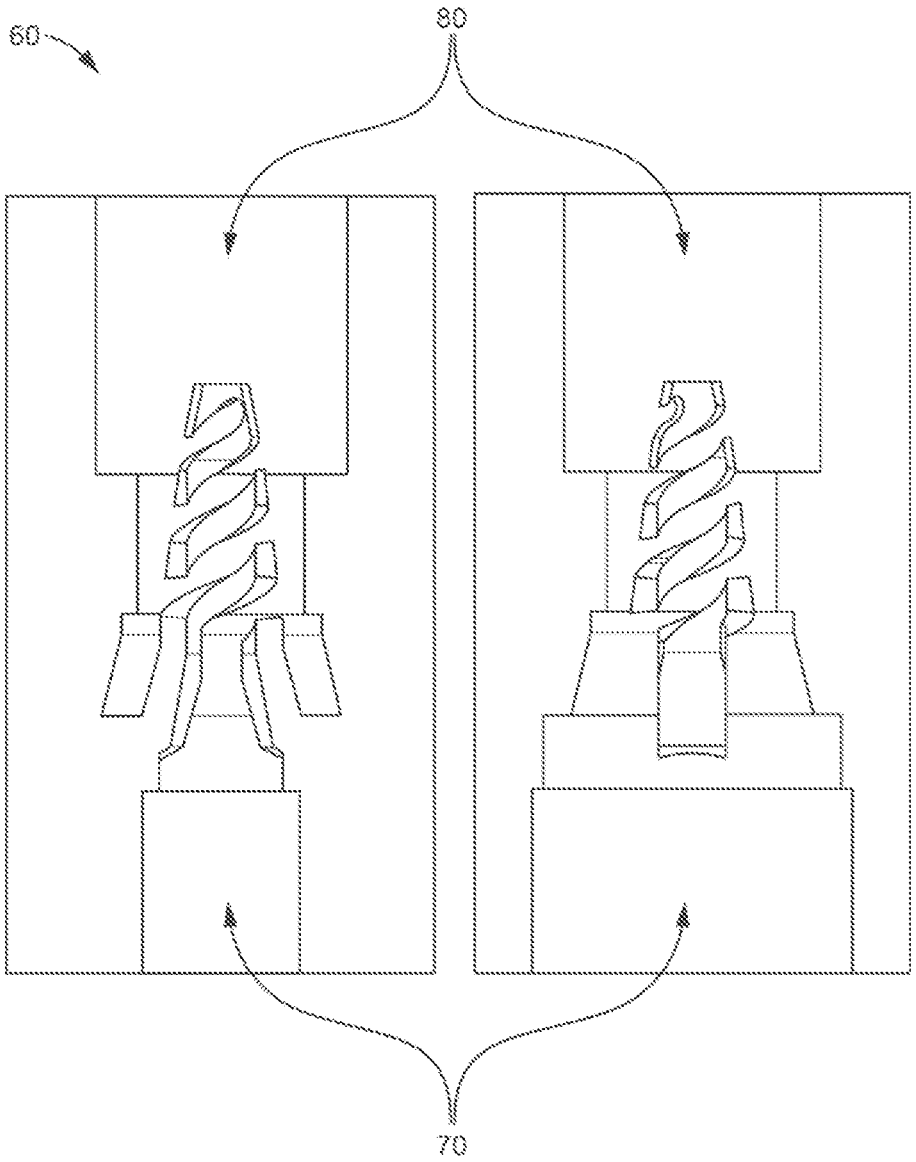
FIG. 7 shows a first and second cross-sectional view of a waveguide polarizer according to some embodiments.

FIG. 6 shows a first and second cross-sectional view of a waveguide polarizer 60 according to some embodiments. As may be seen in the example shown in FIG. 6, the waveguide polarizer 60 may also be used the same way as a septum polarizer. In this example, the first waveguide 70, or first waveguide port, is a rectangular waveguide, while the opposite second waveguide 80, or second waveguide port, is a circular waveguide.

Furthermore, in some embodiments, the length of the second waveguide 80 of the waveguide polarizer 30, 60 may be adapted such that evanescent modes generated by the waveguide excitation arrangement with a bifilar helical shape 40A, 40B contribute significantly to the antenna radiation properties. This provides more degrees of freedom to optimize the design, but may be considered a more complicated case. Optionally, in some embodiments, the length of the second waveguide 80 of the waveguide polarizer 30, 60 may be adapted such that no evanescent modes generated by the waveguide excitation arrangement with a bifilar helical shape 40A, 40B contribute significantly to the antenna radiation properties. This would advantageously ensure that there is no interaction with the evanescent modes, which could be advantageous in some cases.

The description of the example embodiments provided herein have been presented for purposes of illustration. The description is not intended to be exhaustive or to limit example embodiments to the precise form disclosed, and modifications and variations are possible in light of the above teachings or may be acquired from practice of various alternatives to the provided embodiments. The examples discussed herein were chosen and described in order to explain the principles and the nature of various example embodiments and its practical application to enable one skilled in the art to utilize the example embodiments in various manners and with various modifications as are suited to the particular use contemplated. The features of the embodiments described herein may be combined in all possible combinations of methods, apparatus, modules, systems, and computer program products. It should be appreciated that the example embodiments presented herein may be practiced in any combination with each other.

It should be noted that the word "comprising" does not necessarily exclude the presence of other elements or steps than those listed and the words "a" or "an" preceding an element do not exclude the presence of a plurality of such elements. It should further be noted that any reference signs do not limit the scope of the claims, that the example embodiments may be implemented at least in part by means of both hardware and software, and that several "means", "units" or "devices" may be represented by the same item of hardware.

The embodiments herein are not limited to the above-described preferred embodiments. Various alternatives, modifications and equivalents may be used. Therefore, the above embodiments should not be construed as limiting.

What is claimed is:

1. A waveguide polarizer for converting between a linearly polarized electromagnetic field in a first waveguide and a circularly polarized electromagnetic field in a second waveguide, wherein the waveguide polarizer comprising:

a structure interconnecting the first and second waveguide comprising a waveguide excitation arrangement with a bifilar helical shape, wherein the structure comprises a transition waveguide interconnecting the first waveguide to a third waveguide, wherein the transition waveguide provides an impedance match between the first waveguide and the third waveguide.

2. The waveguide polarizer according to claim 1, wherein the waveguide excitation arrangement with the bifilar helical shape is galvanically connected to the first waveguide on opposing sides.

3. The waveguide polarizer according to claim 2, wherein the waveguide excitation arrangement with the bifilar helical shape is galvanically connected to ridges on opposing sides of the first waveguide.

4. The waveguide polarizer according to claim 1, wherein the first waveguide has a super-elliptical cross-section.

5. The waveguide polarizer according to claim 1, wherein the first waveguide has a rectangular cross-section.

6. The waveguide polarizer according to claim 1, wherein the first waveguide has a rectangular cross-section with rounded edges.

7. The waveguide polarizer according to claim 1, wherein the first waveguide has a cross-section including ridges.

8. The waveguide polarizer according to claim 1, wherein the second waveguide has a super-circular cross-section.

9. The waveguide polarizer according to claim 1, wherein the second waveguide has a circular cross-section.

10. The waveguide polarizer according to claim 1, wherein the second waveguide has a square cross-section.

11. The waveguide polarizer according to claim 1, wherein the second waveguide has a square cross-section with rounded edges.

12. The waveguide polarizer according to claim 1, wherein the transition waveguide has a length that is a quarter of the wavelength of the propagating electromagnetic field in the first waveguide.

13. A circularly polarized antenna arranged to be connected to a second waveguide of a waveguide polarizer for converting between a linearly polarized electromagnetic field in a first waveguide and the circularly polarized electromagnetic field in the second waveguide, wherein the waveguide polarizer comprising:

a structure interconnecting the first and second waveguide comprising a wave-guide excitation arrangement with a bifilar helical shape, wherein the structure comprises a transition waveguide interconnecting the first waveguide to a third waveguide, wherein the transition waveguide provides an impedance match between the first waveguide and the third waveguide.

14. The circularly polarized antenna according to claim 13, wherein the length of the second waveguide of the waveguide polarizer is such that evanescent modes generated by the waveguide excitation arrangement contribute significantly to the antenna radiation properties.

15. The circularly polarized antenna according to claim 13, wherein the length of the second waveguide of the waveguide polarizer is such that no evanescent modes generated by the waveguide excitation arrangement contribute significantly to the antenna radiation properties.

16. The circularly polarized antenna according to claim 13, further comprising one or more choke rings arranged around the second waveguide.

17. A satellite arrangement comprising a waveguide polarizer for converting between a linearly polarized electromagnetic field in a first waveguide and a circularly polarized electromagnetic field in a second waveguide, wherein the waveguide polarizer comprising:

a structure interconnecting the first and second waveguide comprising a wave-guide excitation arrangement with a bifilar helical shape;

wherein the structure comprises a transition waveguide interconnecting the first waveguide to a third waveguide, wherein the transition waveguide provides an impedance match between the first waveguide and the third waveguide.

* * * * *